United States Patent [19]

Liu et al.

[11] 4,410,371

[45] Oct. 18, 1983

[54] LONG RANGE ORDERED ALLOYS MODIFIED BY GROUP IV-B METALS

[75] Inventors: Chain T. Liu; Henry Inouye; Anthony C. Schaffhauser, all of Oak Ridge, Tenn.

[73] Assignee: The United States of America as represented by the U.S. Department of Energy, Washington, D.C.

[21] Appl. No.: 266,246

[22] Filed: May 22, 1981

[51] Int. Cl.[3] ..... C22F 1/00; C22C 30/00

[52] U.S. Cl. ..... 148/11.5 R; 148/11.5 N; 148/12 R; 148/12 B; 148/31; 148/425; 148/442; 376/900

[58] Field of Search ..... 75/122, 134 F, 170; 148/11.5 R, 11.5 N, 12 R, 12 B, 31, 32; 176/88

[56] References Cited

U.S. PATENT DOCUMENTS 4,144,059 3/1979 Liu et al. ..... 75/170

4,238,229 12/1980 Liu et al. ..... 75/122

*Primary Examiner*—R. Dean

*Attorney, Agent, or Firm*—C. Clay Carter; Stephen D. Hamel; Richard G. Besha

[57] ABSTRACT

Ductile long range ordered alloys having high critical ordering temperatures exist in the (V,M)(Fe,Ni,Co)$_3$ system having the composition comprising by weight 20.6%–22.6% V, 14–50% Fe, 0–64% Co, and 0–40% Ni, and 0.4–1.4% M, where M is a metal selected from the group consisting of Ti, Zr, Hf, and their mixtures. These modified alloys have an electron density no greater than 8.00 and exhibit marked increases at elevated temperature in ductility and other mechanical properties over previously known ordered alloys.

7 Claims, 2 Drawing Figures

LONG RANGE ORDERED ALLOYS MODIFIED BY GROUP IV-B METALS

BACKGROUND OF THE INVENTION

This invention relates to long range ordered alloys of the transition metals V, Fe, Ni, Co, and the like, and more specifically to modification of such alloys by substituting a quantity of Group IV-B metal(s) for a like quantity of V in these alloys to improve mechanical properties at elevated temperatures. This invention was made as a result of a contract with the U.S. Department of Energy.

Long range ordered (LRO) alloys are like intermetallic compounds whose atoms are arranged in order below a critical ordering temperature, $T_C$. The term "long range order" refers to alloys having ordered structure extending for a distance of more than about 100 atoms in a single domain. Group IV-B metals are Ti, Zr, Hf, and their mixtures as classified in the periodic table of Webster's 3d New International Dictionary, P. B. Gove, Ed., G&C Merriam Co., Springfield, Mass. (1967).

A principal disadvantage associated with high-temperature applications of LRO alloys has been lack of ductility or tensile elongation reducing fabricability due to brittleness. One approach for improving ductility and subsequent applicability to structural components for LRO alloys is disclosed in assignee's U.S. Pat. No. 4,144,059 which issued Mar. 13, 1979, in the name of Chain T. Liu and Henry Inouye, entitled "Ductile Long Range Ordered Alloy With High Critical Ordering Temperature and Wrought Articles Fabricated Therefrom." The Co-based alloys described therein have the nominal composition $V(Co,Fe)_3$ or $V(Co,Fe,Ni)_3$ and comprise by weight 22–23% V, 14–30% Fe, 37–64% Co, and 0–10% Ni. The alloys (LRO-1 to 4) of this patent are relatively expensive due to the high cost limited supply of cobalt and have limited applicability in nuclear environments because of the high neutron-absorption cross section of cobalt.

Another approach to providing ductile LRO alloys is disclosed in assignee's U.S. Pat. No. 4,238,229 which issued Dec. 9, 1980, in the name of Chain T. Liu, et al, entitled "Fe-Based Long Range Ordered Alloy." The Fe-based alloys described therein have the nominal composition $V(Fe,Ni)_3$ or $V(Fe,Ni,Co)_3$ and comprise by weight 22–23% V, 35–50% Fe, 0–22% Co, and 19–40% Ni. These alloys contain less than 22% by weight Co and have superior nuclear properties and lower costs than Co-based alloys of U.S. Pat. No. 4,144,059. The Fe-based alloys also exhibit improved mechanical properties at elevated temperatures. However, these improved properties of Fe-based alloys (LRO-15 to 18) occur at slightly lower temperatures than for Co-based alloys of U.S. Pat. No. 4,144,059.

Inasmuch as the LRO alloys described in the aforementioned patents are essentially the alloys modified by the present invention, these patents are incorporated herein by reference.

While elevated temperature performance of these patented Co and Fe-based LRO alloys is generally several orders of magnitude better than conventional or disordered alloys, their ductility decreases as their critical ordering temperatures ($T_C$) are approached. Sigma phase embrittlement of alloys of the referenced patents has also been noted at elevated temperatures whenever the Fe content in the alloy composition exceeds about 20% by weight. This sigma phase formation is difficult to remove because the sigma phase retained below $T_C$ cannot be easily annealed out due to the lower $T_C$ of Fe-based LRO alloys.

It will be appreciated that long range ordered alloys of these patented $VCo_3$ and $VFe_3$ formulations may be limited in structural and component applications involving high temperature and nuclear environments. In order to reduce these limitations, there is a need for an alloy formulation which will provide improved mechanical properties at elevated temperatures while suppresing brittle sigma phase formation.

SUMMARY OF THE INVENTION

Accordingly, it is a principal object of this invention to provide ductile long range ordered alloys of the $VCo_3$ and $VFe_3$ type which experience better mechanical and metallurgical properties at elevated temperatures than $VCo_3$ and $VFe_3$ LRO alloys described in the aforementioned patents.

It is another object of this invention to provide a long range ordered alloy formulation containing Group IV-B metals in concentration amounts ranging from 0.4 to 1.4% by weight suitable for suppressing sigma phase formation in $VFe_3$ alloys or in $VCo_3$ alloys containing in excess of 20% by weight of iron.

These and other objects are achieved by Co-based or Fe-based LRO alloys of the present invention which have the nominal composition $(V,M)(Fe,Ni,Co)_3$, and comprise by weight 20.6% to 22.6% V, 14–50% Fe, 0–40% Ni, 0–64% Co, and 0.4–1.4% by weight of a metal, M, selected from the Group IV-B metals consisting of Ti, Zr, Hf, and their mixtures. During preparation of these alloys, the metal m is substituted for a like amount of V in either of said Co or Fe-based alloys.

Alloys of this invention have an electron density (e/a) no greater than about 8.00.

DETAILED DESCRIPTION

Figure 1:
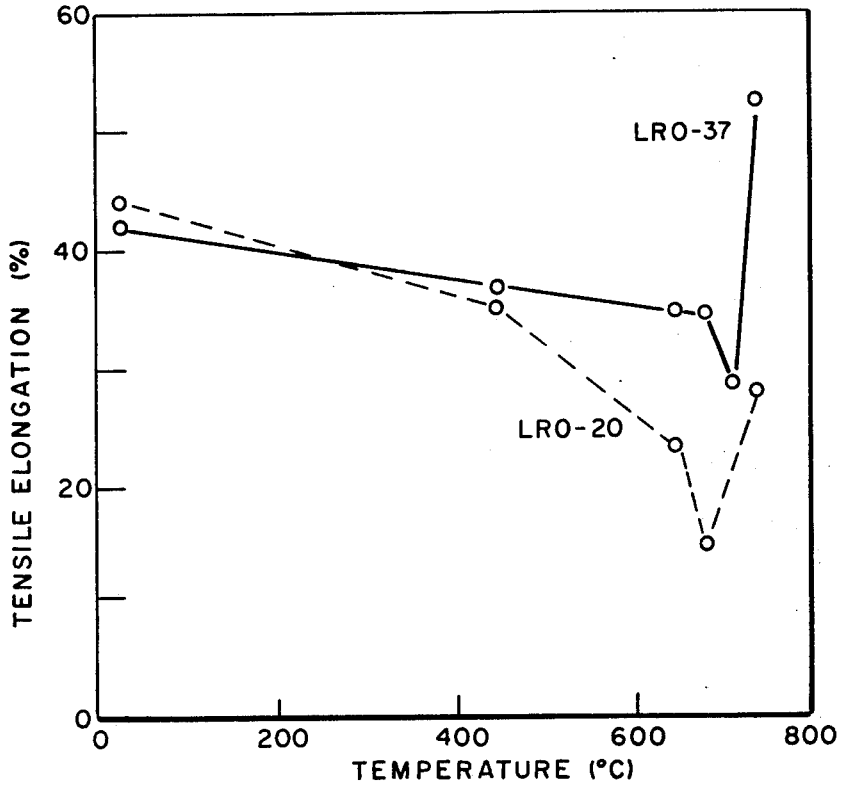
FIG. 1 is a graph of tensile elongation as a function of temperature of an alloy composition of this invention compared to an alloy of U.S. Pat. No. 4,238,229 which has the same composition except for the substitution of 0.4 wt.% Ti for a like amount of V.

In accordance with the present invention, it was discovered that substitution of minor amounts of Group IV-B metals ranging from about 0.4 to 1.4% by weight for like quantities of V to alloys having essentially the composition of $VCo_3$ alloys of U.S. Pat. No. 4,144,059 and $VFe_3$ alloys of U.S. Pat. No. 4,238,229 can produce marked improvements in mechanical and metallurgical properties of the alloys.

Accordingly, the present invention is directed to an LRO alloy composition, nominally $(V,M)(Fe,Ni,CO)_3$, and comprises an alloy selected from the group of alloy compositions consisting essentially of Co-based alloys comprising by weight 20.6%–22.6% V, 14–30% Fe, 37–64% Co, 0–10% Ni, and 0.4–1.4% M and of Fe-based alloys comprising by weight 20.6–22.6% V, 35–50% Fe, 0–22% Co, and 19–40% Ni, and 0.4–1.4%

M, where M is a metal selected from the group consisting of Ti, Zr, Hf, and their mixtures.

It was also discovered that the presence of 0.4 to 1.4 wt.% of Group IV-B metal will suppress formation of an embrittling sigma phase in LRO alloy compositions of $VFe_3$ and $VCo_3$ having more than about 20 wt.% iron. Previous experience had indicated that sigma phase formation could not be alleviated in the patented LRO alloys unless they contained at least 37% by weight Ni or Co and Ni.

A number of sources of the requisite metals can be utilized in formulating the alloy compositions of this invention. For example, commercial ferrovanadium compositionally contains by weight 85–90% V, 10–15% Fe, and trace impurities such as 1–4% $O_2$, Al, or Si. Other commercial alloys, scrap, or pure metals may be added to this ferrovanadium steel to provide the requisite metals in suitable proportions for the intended alloy compositions of this invention.

EXAMPLE

In order to provide a more facile understanding of the present invention modified LRO alloys having a Co-base (LRO-23 and LRO-34) and alloys having an Fe-base (LRO-35 and LRO-37) were prepared and tested by employing essentially the same procedures as set forth in assignee's aforementioned U.S. Pat. Nos. 4,144,059 and 4,238,229, respectively. Alloys LRO-23 and LRO-35 contained 0.9% by weight of Ti and alloys LRO-34 and LRO-37 contained only 0.4 wt.% Ti. Alloys LRO-23 and LRO-34 are a modified form of alloy LRO-1 (23V-16Fe—Co) of U.S. Pat. No. 4,144,059, and alloys LRO-35 and LRO-37 are modified compositions of alloy LRO-16 (23V-33Ni—Fe) and alloy LRO-20 (23V-37Ni—Fe), respectively within the scope of U.S. Pat. No. 4,238,229.

Cold-rolled sheets of these modified alloys appeared of good quality without any discernable defects caused by Ti addition. Microstructural examination revealed a stable, ordered structure with suppressed sigma phase formation. Critical ordering temperatures remained about the same for alloys LRO-23 and LRO-34 of this invention while a slight increase in $T_C$ of about 20° C. was found in our alloys LRO-35 and LRO-37. Data from mechanical tests are presented in summarized form in Tables I and II. It will be seen from these data that the modified LRO alloy compositions of the present invention are preferred over conventional, disordered, or ordered alloys as previously known.

In Table I, alloy LRO-37 was subjected to several mechanical tests with results compared to alloy LRO-20. Addition of Ti within concentration ranges dictated by our invention has little effect on yield strength of LRO-37 at low and moderate temperatures but provided superior yield and ultimate tensile strengths at elevated temperatures. Ductility, which is expressed herein as a percentage of tensile elongation, is shown in Table I and is graphically depicted in FIG. 1. The enhancement of ductility by Ti addition is shown by comparison of the LRO-37 composition of this invention with that of prior work LRO-20. As shown in Table I and FIG. 1, a gradual decrease in tensile elongation occurs in both alloy LRO-37 and LRO-20 as the temperature increases up to their respective $T_C$'s of 670° C. and 690° C. Typically, the decrease in ductility for the alloy LRO-37 of this invention is more gradual than the decrease for the known alloy LRO-20, especially at temperatures greater than about 450° C. As also shown in Table I and FIG. 1, alloy LRO-37 exhibits substantial improvements in tensile strength especially over a temperature range of about 250°–720° C. as compared to alloy LRO-20.

TABLE I

| Temperature (°C.) | Yield Strength (MPa) | Ultimate Tensile Strength (MPa) | Elongation (%) |
|---|---|---|---|
| | | LRO-20 | |
| RT | 309.4 | 1033.5 | 43.8 |
| 450 | 336.2 | 887.4 | 35.1 |
| 650 | 376.9 | 697.3 | 23.1 |
| 680 | 278.4 | 479.5 | 14.6 |
| 740 | 216.4 | 413.4 | 31.3 |
| | | LRO-37 | |
| RT | 275.6 | 1223.0 | 41.8 |
| 450 | 318.3 | 1030.7 | 36.5 |
| 650 | 373.4 | 925.3 | 34.5 |
| 680 | 428.6 | 853.0 | 34.5 |
| 710 | 421.0 | 745.5 | 28.3 |
| 740 | 232.0 | 505.7 | 52.1 |

Figure 2:
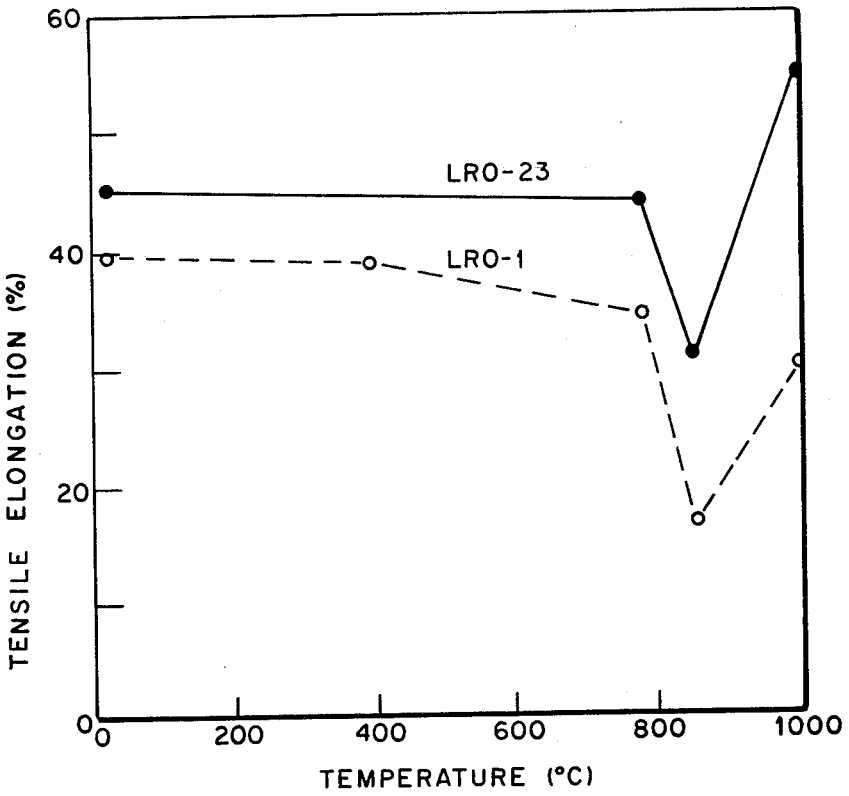
FIG. 2 is a graph of tensile elongation as a function of temperature of an alloy composition of this invention compared to an alloy of U.S. Pat. No. 4,144,059 which has the same composition except for the substitution of 0.9 wt.% Ti for a like amount of V.

For high temperature structural and related component applications, such as energy conversion and utilization systems, it is important that candidate materials also have good creep ductility at elevated temperatures. Table II sets forth summarized results of mechanical tests of alloys LRO-23 and 34 of this invention. In a comparison of these LRO alloys with a known alloy LRO-1, a significant improvement in rupture ductility is provided by Ti substitution in tests conducted at 871° C. and 68.9 MPa. As can also be seen in Table II, steady state creep remains apparently unaffected by use of different concentration in alloys LRO-23 and LRO-34. FIG. 2 graphically illustrates that ductility or tensile elongation of alloy LRO-23 remains essentially constant between room temperature and about 800° C. while known alloy LRO-1 undergoes a gradually increasing reduction in tensile strength as temperature increases.

TABLE II

| Alloy | Steady State Creep Rate (cm/cm/hr)* | Rupture Ductility (%) |
|---|---|---|
| LRO-1 | $1.6 \times 10^{-4}$ | 15 |
| LRO-34 | $1.3 \times 10^{-4}$ | 64 |
| LRO-23 | $1.8 \times 10^{-4}$ | 48 |

*At 871° C. and 68.9 MPa

Structural materials used in severe nuclear environments also require resistance to damage by bombardment of energetic atoms or ions. Irradiation tests of alloys of this invention with 4 MeV Ni ions over a range of temperatures has shown improved resistance to radiation damage. Modified Fe-based alloy LRO-35 exhibited a reduced swelling rate at 650° C. of about one order of magnitude less than patented alloy LRO-16. While the low radiation damage behavior of this Fe-based alloy approached that of the Co-based alloys of U.S. Pat. No. 4,144,059 it is not known for certain whether sigma phase suppression in our modified alloys is responsible for this improved resistance.

A number of other alloy compositions were similarly prepared and tested. No significant differences in ductility of the subject alloys were noted for additions of 0.4% or 0.9% by weight of Ti. Thus, the particular concentration of Ti does not appear to be critical within the range of 0.4 to 1.4% by weight. Alloy modifications below 0.4% by weight Ti gave very little improvement in ductility over alloy compositions described in assignee's aforementioned patents. Alloy modifications of about 1.5 to 2.0% by weight Ti initiated formation of an undesirable second phase. Therefore, it is preferred that Ti additions be maintained within the optimal range of 0.4 to 1.4% by weight and preferably within the ideal range of 0.4 to 0.9% by weight. Substantially similar results were obtained by modification of the patented LRO alloy systems with Zr additions within the same range. It is also expected that Hf and mixtures of Ti, Zr, and Hf would provide essentially the same alloy improvements as Ti and Zr.

While the exact mechanism providing enhanced ductility of the subject LRO alloys is not clear, it is believed that impurities, such as sulfur, which migrate to grain boundaries during deformation to reduce ductility are captured by Group IV-B metals which function as a getter for said impurities. Inclusion of other metals, such as Si, Cr, Mo, and Al, in trace quantities (about 0.4 to 0.9 wt.%) had little effect on ductility of the alloys of the present invention. However, their presence may be desirable to enhance mechanical properties of the modified alloys of this invention. For example, a trace quantity of Al may be added to enhance oxidation resistance in steam generation or like applications. Other alloys of similar known oxidation or corrosion resistant properties may be added in trace amounts depending upon the anticipated application of the modified alloy.

Table III depicts in summary form results of corrosion testing of alloy LRO-35 of this invention at two separate temperatures of molten Li. Long-term compatability with liquid metals at elevated temperatures is essential for structural materials of a fusion reactor or of a molten-metal heat exchanger. Incoloy 800 having Fe and Ni concentrations similar to alloy LRO-35 exhibited inferior corosion resistance at 50% less exposure times. Subsequent tensile elongation tests on an exposed LRO-35 alloy demonstrated essentially no change in this mechanical property following prolonged exposure to a corrosive Li environment.

TABLE III

| Temperature °C. | Weight Change g/m$^2$ | |
|---|---|---|
| | Incoloy 800[a] | LRO-35[b] |
| 500 | +16.3, −49.9 | −0.2, −0.5, −0.5 |
| 600 | −2.4, −121.3 | −0.2, −0.5, −0.5 |

[a]1000 hr exposure, two tests at each temperature (21Cr—33Ni—46Fe)
[b]2000 hr exposure, three tests at each temperature (0.9Ti—22.1V—33Ni—44Fe)

Thus, it can readily be concluded that Group IV-B modified alloys of this invention provide improved properties in assignee's patented LRO alloys which enhance their applicability in nuclear and elevated temperature environments. Many variations in the present invention will be apparent to those skilled in the art for which it is intended. However, such variations are embodied within the scope of the following claims.

What is claimed is:

1. A long range ordered alloy composition, said alloy having the nominal composition $(V,M)(Fe,Ni,Co)_3$, and obtained by modification of an alloy selected from the group of long range ordered alloys consisting of a cobalt-based alloy comprising by weight 22–23% V, 14–30% Fe, 37–64% Co, and 0–10% Ni, and of an iron-based alloy comprising by weight 22–23% V, 35–50% Fe, 0–22% Co, and 19–40% Ni, wherein said modification comprises the substitution of 0.4–1.4 wt.% of a metal, M, selected from the group consisting of Ti, Zr, Hf, and their mixtures, for a like amount of V in either of said cobalt or iron-based alloys.

2. A fabricated article of manufacture in the form of plate, sheet, rod, wire, foil, and the like, having the composition of claim 1.

3. In an apparatus having a structural component exposed to a temperature greater than 300° C., the improvement in which said component comprises the alloy of claim 1.

4. In an article having a structural component exposed to a nuclear environment, the improvement in which said component comprises the alloy of claim 1.

5. In an article having a structural component exposed to a liquid metal environment at elevated temperatures, the improvement in which said component comprises the corrosion resistive alloy of claim 1.

6. A method for fabricating articles from the alloy of claim 1 comprising deforming said alloy at a temperature above the critical ordering temperature of said alloy to provide a wrought article and annealing said wrought article for a sufficient time to provide a long range ordered structure in said wrought article.

7. A method for fabricating articles from the alloy of claim 1 comprising deforming said alloy at a temperature below the critical ordering temperature of said alloy to provide a wrought article and annealing said wrought article for a sufficient time to provide a long range ordered structure in said wrought article.

* * * * *